US011970944B2

(12) United States Patent
Zaayman

(10) Patent No.: US 11,970,944 B2
(45) **Date of Patent: *Apr. 30, 2024**

(54) MINERAL BITS AND MOUNTS

(71) Applicant: CARRIERE INDUSTRIAL SUPPLY LIMITED, Lively (CA)

(72) Inventor: Oswald D. Zaayman, Louisville, CO (US)

(73) Assignee: CARRIERE INDUSTRIAL SUPPLY LIMITED, Lively (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/152,899

(22) Filed: Jan. 20, 2021

(65) Prior Publication Data

US 2021/0199007 A1 Jul. 1, 2021

Related U.S. Application Data

(63) Continuation of application No. 16/370,086, filed on Mar. 29, 2019, now Pat. No. 10,900,356, which is a (Continued)

(51) Int. Cl.
*E21C 35/193* (2006.01)
*E21C 35/19* (2006.01)
(Continued)

(52) U.S. Cl.
CPC ..... *E21C 35/1936* (2013.01); *E21C 35/19* (2013.01); *E02F 9/2816* (2013.01);
(Continued)

(58) Field of Classification Search
CPC ..... E21C 35/18; E21C 35/188; E21C 35/19; E21C 35/193; E21C 35/1936;
(Continued)

(56) References Cited

U.S. PATENT DOCUMENTS 2,330,081 A 9/1943 Phipps
2,747,852 A 5/1956 Krekeler
(Continued)

FOREIGN PATENT DOCUMENTS

DE 33 17 145 A1 11/1984
DE 3242144 2/1987
(Continued)

OTHER PUBLICATIONS

Palmieri Group, Special Tools, pp. 1-4, Apr. 23, 2013.
(Continued)

*Primary Examiner* — Abby J Flynn
*Assistant Examiner* — Michael A Goodwin
(74) *Attorney, Agent, or Firm* — Palmer Dzurella

(57) ABSTRACT

Mineral bits (10, 100) and associated mounts (30, 116, 200) for use during excavation and mining operations are disclosed. An exemplary bit (10) has a front region (12) and an opposite rear region (14) and comprises a head portion (16) and a mounting portion (18) secured to the head portion (16). The mounting portion (18) can be configured to be releasably retained by a mount (30). A rounded transition (22) disposed in the front region (12) of the bit between the head portion (16) and the mounting portion (18) provides a clearance (C) between the head portion (16) and the mount (16). Mineral bits (10, 100) disclosed can be inserted into and withdrawn from mounts (30, 116, 200) by linear and/or rotational movement.

18 Claims, 7 Drawing Sheets

Related U.S. Application Data continuation of application No. 14/397,787, filed as application No. PCT/CA2013/000420 on Apr. 29, 2013, now Pat. No. 10,294,787.

(60) Provisional application No. 61/687,630, filed on Apr. 30, 2012.

(51) Int. Cl.
*E02F 9/28* (2006.01)
*E21C 35/18* (2006.01)

(52) U.S. Cl.
CPC ..... *E02F 9/2841* (2013.01); *E02F 9/2858* (2013.01); *E02F 9/2866* (2013.01); *E21C 35/188* (2020.05)

(58) Field of Classification Search
CPC ..... E21C 2035/1826; E21C 35/191; E21C 35/1933; E21C 35/197; B28D 1/186; E02F 9/2816; E02F 9/2841; E02F 9/2858; E02F 9/2866
See application file for complete search history.

(56) References Cited

U.S. PATENT DOCUMENTS

| | | | | |
|---|---|---|---|---|
| 2,766,029 | A | | 10/1956 | Bruestle |
| 2,965,365 | A | | 12/1960 | Krekeler |
| 3,010,709 | A | | 11/1961 | Bentley et al. |
| 3,114,537 | A | | 12/1963 | Krekeler |
| 3,205,015 | A | | 9/1965 | Krekeler |
| 3,526,435 | A | | 9/1970 | Krekeler |
| 3,992,061 | A | | 11/1976 | Rollins |
| 4,143,920 | A | | 3/1979 | Haddock |
| 4,154,483 | A | | 5/1979 | Hollingworth |
| 4,261,619 | A | | 4/1981 | Howe et al. |
| 4,274,677 | A | | 6/1981 | Proctor |
| 4,456,307 | A | | 6/1984 | Merten et al. |
| 4,557,525 | A | | 12/1985 | Merten |
| 4,609,227 | A | | 9/1986 | Wild et al. |
| 4,626,034 | A | | 12/1986 | Breuer et al. |
| 4,650,255 | A | | 3/1987 | Staroba |
| 4,762,372 | A | | 8/1988 | Rassmann et al. |
| 5,011,229 | A | | 4/1991 | O'Neill et al. |
| 5,092,310 | A | | 3/1992 | Walen et al. |
| 5,092,660 | A | | 3/1992 | Steinkuhl et al. |
| 5,195,805 | A | * | 3/1993 | Clapham ..... E21C 35/187 299/81.3 |
| 5,201,569 | A | * | 4/1993 | Jurgen ..... E21C 35/19 299/110 |
| 5,235,961 | A | | 8/1993 | McShannon |
| 5,873,423 | A | | 2/1999 | Briese |
| 5,906,245 | A | | 5/1999 | Tibbitts et al. |
| 10,294,787 | B2 | | 5/2019 | Zaayman |
| 10,900,356 | B2 | | 1/2021 | Zaayman |
| 2008/0309146 | A1 | | 12/2008 | Hall et al. |
| 2012/0001475 | A1 | | 1/2012 | Dubay et al. |
| 2014/0312678 | A1 | * | 10/2014 | Parrott ..... E21C 35/187 299/81.3 |

FOREIGN PATENT DOCUMENTS

| | | |
|---|---|---|
| DE | 3528440 | 2/1987 |
| DE | 4007347 | 9/1991 |
| GB | 2178782 | 2/1987 |

OTHER PUBLICATIONS

Palmieri Group, Radial Tools and Holders, pp. 1-8, Apr. 23, 2013.
Canadian first Office Action in Application 2870929, dated Aug. 31, 2018, 3 pages.
Canadian fourth Office Action in Application 2870929, dated Apr. 7, 2021, 4 pages.
Canadian second Office Action in Application 2870929, dated Jun. 27, 2019, 6 pages.
Canadian third Office Action in Application 2870929, dated Aug. 5, 2020, 6 pages.
PCT International Preliminary Report on Patentability in International Application PCT/CA2013/000420, dated Nov. 13, 2014, 7 pages.
PCT International Search Report and Written Opinion in International Application PCT/CA2013/000420, dated Mar. 20, 2013, 10 pages.

* cited by examiner

MINERAL BITS AND MOUNTS

CROSS REFERENCE TO RELATED APPLICATIONS AND CLAIM OF PRIORITY

The present application is a continuation of U.S. patent application Ser. No. 16/370,086 filed on Mar. 29, 2019, now U.S. Pat. No. 10,900,356, issued on Jan. 26, 2021, which is a continuation of U.S. patent application Ser. No. 14/397,787 filed on Oct. 29, 2014, now U.S. Pat. No. 10,294,787, issued on May 21, 2019, which is a U.S. National Stage Application of PCT/CA2013/000420 filed on Apr. 29, 2013, which claims benefit of U.S. Patent Application No. 61/687,630 filed Apr. 30, 2012 and which applications are incorporated herein by reference. To the extent appropriate, a claim of priority is made to each of the above disclosed applications.

TECHNICAL FIELD

The disclosure relates generally to excavation and mining operations, and more particularly to mineral bits and associated mounts for use during such operations.

BACKGROUND OF THE ART

Mineral bits, also known as drill bits, cutter bits, cutter picks, cutting tips, drill tips, etc. are used in excavation and mining operations. Such bits are typically used on rock boring drill machines for underground earth moving activities typically conducted in underground mines and also tunnel boring operations. Mineral bits are typically releasably retained via suitable mounts secured to a piece of equipment.

Mineral bits are considered a consumable item which may need replacement after a period of use due to failure/fracture (e.g., breaking) or due to partial or complete loss in performance (e.g., cutting ability) due to wear. Depending on the particular application and forces to which a mineral bit may be subjected to, breaking or other condition requiring replacement of mineral bits can occur on a regular basis. In some applications the replacement of mineral bits can be relatively difficult and time consuming and can result in significant downtime of an associated piece of equipment and hence increased costs of an excavation or mining-related operation.

Improvement is therefore desirable.

SUMMARY

The disclosure describes components, apparatus and methods for use in excavation and mining-related operations. In particular, the disclosure describes mineral bits and associated mounts by which mineral bits are retained.

In one aspect, the disclosure describes a mineral bit for use during excavation and mining operations. The bit may have a front region and an opposite rear region. The bit may also comprise:

- a head portion;
- a mounting portion secured to the head portion and configured to be releasably retained by a mount;
- a rounded transition disposed in the front region of the bit between the head portion and the mounting portion and configured to provide a clearance between the head portion and the mount when the mounting portion is releasably retained by the mount; and

- a rear shoulder surface disposed on the head portion in the rear region of the bit and configured to interface with the mount when the mounting portion is releasably retained by the mount.

In another aspect, the disclosure describes an apparatus for use during excavation and mining operations. The apparatus may comprise:

- a mount having a receptacle; and
- a mineral bit having a front region and an opposite rear region, the mineral bit comprising:
  - a head portion;
  - a mounting portion secured to the head portion, at least part of the mounting portion being configured to be releasably retained in the receptacle of the mount;
  - a front rounded transition disposed in the front region of the bit between the head portion and the mounting portion and configured to provide a clearance between the head portion of the bit and the mount when the mounting portion is releasably retained by the mount; and
  - a rear shoulder surface disposed on the head portion in the rear region of the bit and configured to interface with the mount when the mounting portion is releasably retained by the mount.

In another aspect, the disclosure describes a mineral bit for use during excavation and mining operations. The bit may comprise:

- a head portion; and
- a mounting portion, at least part of mounting portion being configured to be releasably retained in a receptacle of a mount, the mounting portion having an interlocking feature for engagement with the mount, the interlocking feature being configured to prevent withdrawal of the bit from the mount along a receptacle axis but to permit withdrawal of the bit from the mount by rotation of the bit relative to the mount about a rotation axis different from the receptacle axis.

In another aspect, the disclosure describes an apparatus for use during excavation and mining operations. The apparatus may comprise:

- a mineral bit having a head portion and a mounting portion, the mounting portion comprising a first interlocking feature; and
- a mount for releasably retaining the bit, the mount having a receptacle for receiving at least part of the mounting portion of the bit, the mount comprising a second interlocking feature for engagement with the first interlocking feature of the mounting portion to prevent withdrawal of the bit from the mount along a receptacle axis, the first and second interlocking features being configured to allow withdrawal of the bit from the mount by rotation of the bit relative to the mount about a rotation axis different from the receptacle axis.

In another aspect, the disclosure describes a method for withdrawing a mineral bit from a mount having a receptacle into which a portion of the bit is releasably retained where a first interlocking feature of the bit is engaged with a second interlocking feature of the mount to prevent withdrawal of the bit along a receptacle axis. The method may comprise:

- rotating the bit relative to the mount about a rotation axis different from the receptacle axis to disengage the first and second interlocking features; and
- withdrawing the bit from the mount.

In another aspect, the disclosure describes a mount for releasably retaining a mineral bit. The mount may comprise:

- a receptacle for receiving at least a portion of the bit;

an interlocking feature for engagement with the bit, the interlocking feature being configured to allow withdrawal of the bit from the mount by rotation of the bit relative to the mount; and an access hole to the receptacle configured to permit access to a tool for initiating rotation of the bit when the portion of the bit is received in the receptacle.

In another aspect, the disclosure describes a method for withdrawing a mineral bit from a mount having a receptacle into which a portion of the bit is releasably retained where a first interlocking feature of the bit is engaged with a second interlocking feature of the mount to prevent withdrawal of the bit along a receptacle axis. The method may comprise:

accessing the receptacle of the mount with a tool;

using the tool to initiate rotation of the bit relative to the mount;

further rotating the bit relative to the mount to disengage the first and second interlocking features; and withdrawing the bit from the mount.

In a further aspect, the disclosure describes a mount for releasably retaining a mineral bit. The mount may comprise:

a receptacle for receiving at least a portion of the bit, the receptacle having a receptacle axis; and an access hole to the receptacle and substantially perpendicular to the receptacle axis, the access hole being configured to permit access to a tool for initiating movement the bit and facilitate withdrawal of the bit from the receptacle.

Further details of these and other aspects of the subject matter of this application will be apparent from the detailed description and drawings included below.

DESCRIPTION OF THE DRAWINGS

Reference is now made to the accompanying drawings, in which.

DETAILED DESCRIPTION

Aspects of various embodiments are described through reference to the drawings.

Figure 1:
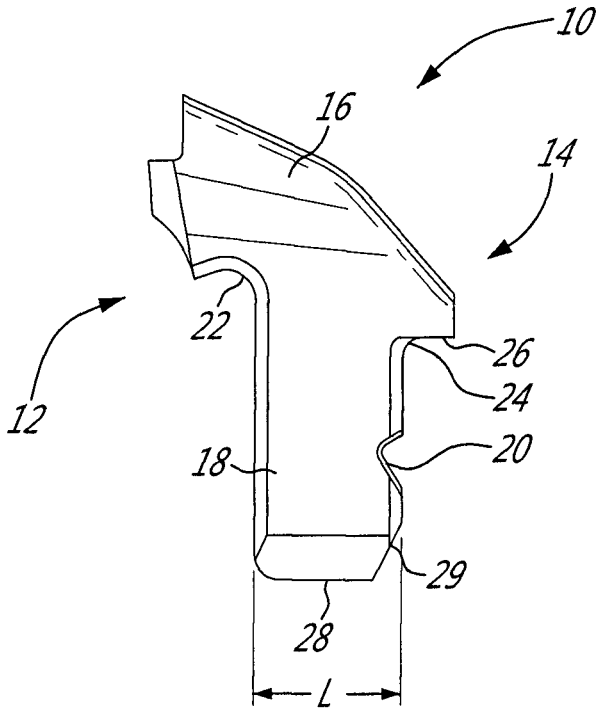
FIG. 1 is a side elevation view of a mineral bit in accordance with one exemplary embodiment.

FIG. 1 shows a side elevation view of a mineral bit 10 in accordance with one exemplary embodiment of the present disclosure. Mineral bit 10 may be used on rock boring drill machines (not shown) for underground earth moving activities typically conducted in underground mines, and also tunnel boring operations. Such drill machines may have a cylindrical part such as a drum configured to be rotated while being driven into the rock/dirt face. Such a rotating drum may be oriented with its center axis parallel to the rock face or perpendicular to the rock face. For example, a surface of the rotating drum that would come into contact with the rock face could comprise a plurality of such mineral bits 10 arranged in a particular fashion so as to cut into the rock face and thereby facilitate removal of the rock/dirt by the machine. Mineral bit 10 may have different configurations to those shown herein. For example, the term "mineral bit" is intended to encompass other types of bits/tools also known as a drill bits, cutter bits, cutter picks, cutting tips, drill tips, etc.

Mineral bit 10 may be a consumable part which may need replacement after a period of use. For example, replacement of mineral bit 10 may be necessary due to failure/fracture (e.g., breaking) of mineral bit 10 or due to partial or complete loss in performance (e.g., cutting ability) of mineral bit 10 due to wear. Mineral bit 10 may be made from materials and processes similar to those used for fabricating conventional bits. For example, mineral bit 10 may be forged or cast from a suitable steel.

Mineral bit 10 may comprise one or more front regions 12, which may face mineral (e.g., rock/dirt) during use and one or more rear regions 14, which may be disposed opposite front region(s) 12. Front region 12 may, for example, comprise a forward region of mineral bit 10 in relation to a direction of movement of mineral bit 10 during use. Mineral bit 10 may comprise one or more head portions 16 and one or more mounting portions 18 (e.g., shanks). Head portion 16 may be configured to contact, cut and/or otherwise process rock/dirt or other type of mineral. Head portion 16 may, for example, be configured to have an integrally formed cutter/processing region and/or may be configured to receive and hold a replaceable cutter/processing insert, which may be made of a material having a relatively high wear resistance (e.g., carbide and/or hardened steel).

Mounting portion 18 may be secured to (e.g., integrally formed with) head portion 16 and be used for releasably coupling mineral bit 10 to a drilling machine or other suitable piece of equipment. The releasable coupling of mineral bit 10 to other equipment may facilitate the replacement of mineral bit 10 if and when necessary. Accordingly, mounting portion 18 may be configured to be releasably retained in a suitable mount (explained further below and shown in FIG. 2) that is secured to a piece of equipment. Mounting portion 18 may include locking notch 20 that may be used to releasably retain mounting portion 18 in place during use.

Mineral bit 10 may, in some embodiments, comprise one or more front rounded transitions 22 disposed in front region 12 of mineral bit 10 between head portion 16 and mounting portion 18. Mineral bit 10 may also comprise, in some embodiments, one or more rear rounded transitions 24 disposed in rear region 14 of mineral bit 10 between head portion 16 and mounting portion 18. The environment in which mineral bit 10 may operate can require special considerations for the shape and geometry of mineral bit 10 and an associated mount. For example, mineral bit 10 may experience severe forces and torques in many directions as it passes over the rough rock face, while cutting a path or slot through the rock. These varying forces and torques can occur many times in a second and hence cause vibrations of varying magnitudes and frequencies and can be considered a fatigue loading environment. In some embodiments, one or both front rounded portion(s) 22 and rear rounded portion(s) 24 may provide improved resistance to fatigue crack initiation and eventual fatigue failure in comparison with other known bits having sharp transitions by reducing the magnitude of stress concentrations that can be associated with sharp transitions. Front regions of rectangular mineral bits may be subject to relatively high stresses including relatively higher tensile stresses than in other regions of such mineral bits. The elimination of sharp internal corners or transitions located in front regions of mineral bits can, in some cases, reduce the likelihood of fracture.

For example, front rounded portion 22 may have a radius of curvature that is at least 20% of a front-to-rear length L of mounting portion 18. In some embodiments, front rounded portion 22 may, for example, have a radius of curvature between 23% and 30% of the front-to-rear length L of mounting portion 18. Front rounded portion 22 may extend across at least a portion of a width W (shown in FIG. 3) or substantially entirely across width W.

For example, rear rounded portion 24 may have a radius of curvature that is at least 12.5% of front-to-rear length L of mounting portion 18. In some embodiments, front rounded portion 24 may, for example, have a radius of curvature between 15% and 20% of the front-to-rear length L of mounting portion 18. Rear rounded portion 24 may extend across at least a portion of a width W (shown in FIG. 3) or substantially entirely across width W.

Mounting portion 18 may comprise a generally elongated upright portion configured to be inserted in a suitable mount. In some embodiments, mounting portion 18 may have a generally rectangular transverse cross-section. For example, mounting portion 18 may have a front-to-rear length L and a width W. Length L may be greater than width W and in some embodiments, length L may be two or more times greater than the width W. The term "generally" is used because the transverse cross-section may not necessarily be perfectly rectangular and also the transverse cross-section may not necessarily be constant across the entirety of mounting portion 18. For example, the transverse cross-section may comprise rounded corners and/or other discontinuities.

Head portion 16 may also have a generally rectangular cross-section having substantially the same orientation as the generally rectangular cross-section of mounting portion 18. For example, a longer side of the rectangular cross-sections may be oriented in the direction of movement of mineral bit 10 during use and a shorter side of the rectangular cross-sections located in a front portion 12 of mineral bit 10 may face the mineral/rock during use.

Mineral bit 10 may also comprise, in some embodiments, one or more shoulder surfaces for interfacing with a suitable mount and providing support of mineral bit 10. For example, mineral bit 10 may comprise one or more rear shoulder surfaces 26 and one or more lower shoulder surfaces 28. Rear shoulder surface 26 may be disposed in rear region 14 of mineral bit 10. For example, rear shoulder surface 26 may be disposed in a lower part of head portion 16. Rear rounded transition 24 may be disposed adjacent rear shoulder surface 26 and may also serve as a shoulder surface for interfacing with a suitable mount. Lower shoulder surface 28 may be disposed in a lower part of mounting portion 18. For example, lower shoulder surface 28 may be disposed in a region of mounting portion 18 opposite head portion 16 (e.g., a lower extremity of mounting portion 18). Mounting portion 18 of mineral bit 10 may also comprise chamfer 29.

Figure 2:
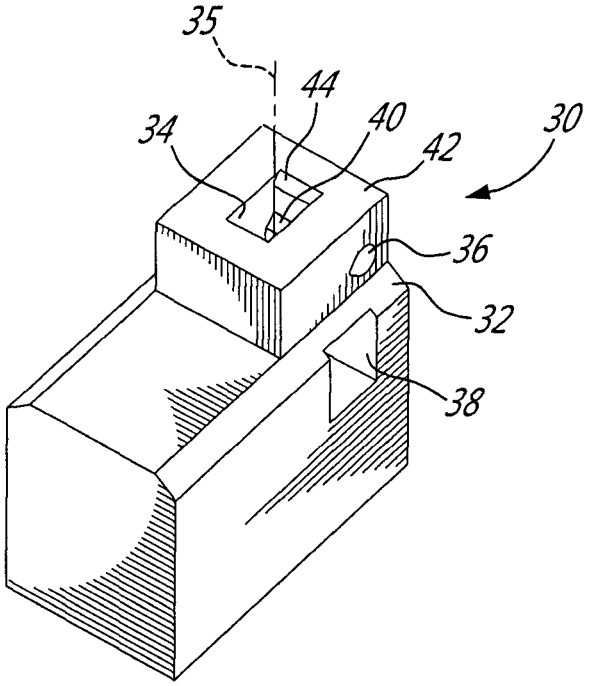
FIG. 2 is an axonometric view of a mount for releasably retaining the mineral bit of FIG. 1.

FIG. 2 illustrates mount 30 for releasably retaining mineral bit 10. Mount 30 may serve to releasably couple mineral bit 10 to a drum of a drilling machine or other suitable piece of equipment (not shown). Accordingly, mount 30 may be permanently secured (e.g., welded or bolted) to such piece of equipment (e.g., rotating drum) and releasably retain mounting portion 18 of mineral bit 10. Mount 30 may comprise mount body 32 into which one or more receptacles 34 may be formed. Receptacle 34 may be shaped and dimensioned to receive at least part of mounting portion 18 of mineral bit 10. Accordingly, receptacle 34 may also have a corresponding generally rectangular transverse cross-section. Receptacle 34 may have a receptacle axis 35. Receptacle axis 35 may extend generally along a longitudinal direction of receptacle 34. For example, receptacle axis 35 may represent a line (e.g., direction) along which mounting portion 18 of mineral bit 10 is inserted into and withdrawn from receptacle 34 of mount 30. While mounting portion 18 of mineral bit 10 and receptacle 34 may be configured for substantially linear insertion of mounting portion 18 into receptacle 34, it is understood that aspects of the present disclosure are also applicable to other types of bits and receptacles which are not necessarily configured for such linear insertion. As explained below some aspects of this disclosure may apply to bits and receptacles that require coupling via relative rotational movement.

Mount 30 may also comprise one or more retainer slots 36 and one or more access holes 38. Retainer slot 36 may extend from an outer wall of mount body 32 into receptacle 34. For example, retainer slot 36 may extend generally transversely (e.g., perpendicular) to axis 35. Retainer slot 36 may be configured to receive retainer device 40 that may be used to releasably retain mounting portion 18 of mineral bit into receptacle 34. For example, retainer device 40 may comprise a substantially rigid inner member covered by a comparatively resilient member. For example, retainer device 40 may comprise a metallic (e.g., steel) inner member and covering made of an elastomeric material (e.g., rubber). Alternatively, retainer device 40 may entirely be made from an elastomeric material. Retainer device 40 may be removed for insertion and/or withdrawal of mounting portion 18 from receptacle 34 or, alternatively, retainer device 40 may be configured to be left in during insertion/removal and simply provide a resistance to insertion/removal. During insertion for example, chamfer 29 on mounting portion 18 may provide a gradual compression of retainer device 40 and then once locking notch 20 reaches retainer device 40, a releasable retention of mounting portion 18 in receptacle 34 may be achieved. Withdrawal of mounting portion 18 of mineral bit 10 from receptacle 34 may be achieved by applying an appropriate force generally along axis 35 to pull mineral bit 10 from mount 30. Such force may be sufficient to cause compression of resilient retainer device 40 so that a lower portion of mounting portion 18 below locking notch 20 may be permitted to slide past retainer device 40.

The specific shape and configuration of mounting portion 18, receptacle 34 and retainer device 40 may be selected so that the magnitude and direction of the force required to cause withdrawal of mineral bit 10 from mount 30 is such that inadvertent withdrawal of mineral bit 10 from mount 30 does not happen during normal use. Access hole 38 may be used to facilitate the withdrawal of mounting portion 18 from receptacle. Access hole 38 may extend into receptacle 34 generally transversely to receptacle axis 35 and provide access to a lower end of mounting portion 18 from outside of mount body 32. For example, access hole 38 may be configured to permit insertion of a suitable bit-removal tool (not shown) to facilitate removal of mounting portion 18 from receptacle 34. For example, such bit-removal tool may include a suitable wedge-shaped tool (not shown) that may be used to apply a force onto mounting portion 18 generally along axis 35 to initiate movement of mineral bit 10 and facilitate withdrawal of mounting portion 18 from receptacle 34. The use of such bit-removal tool may facilitate the removal of mounting portion 18 from receptacle 34 if, for example, head portion 16 has broken off from mounting portion 18 and hence cannot be used for applying a pulling force to withdraw mounting portion 18 from receptacle 34

The use of such bit-removal tool may also facilitate the breaking of any hold provided by fine dust that may have crept between mounting portion 18 and receptacle 34 during use. For example, fine dust can sometimes enter small gaps between receptacle 34 and mounting portion 18 where it can be compacted into relatively hard compound due to the vibrations to which such mineral bit 10 may be exposed. Such hard compound can sometimes require additional force for the withdrawal of mounting portion 18 from receptacle 34.

Mount 30 may also include one or more top surfaces 42, which may be disposed adjacent an opening of receptacle 34. For example, top surface 42 may at least partially surround the opening of receptacle 34. Top surface 42 may provide a corresponding surface for interfacing with one or more shoulder surfaces such as shoulder surface 26 of mineral bit 10. Mount 30 may also comprise one or more rounded transitions 44 disposed between top surface 42 and receptacle 34.

Figure 3:
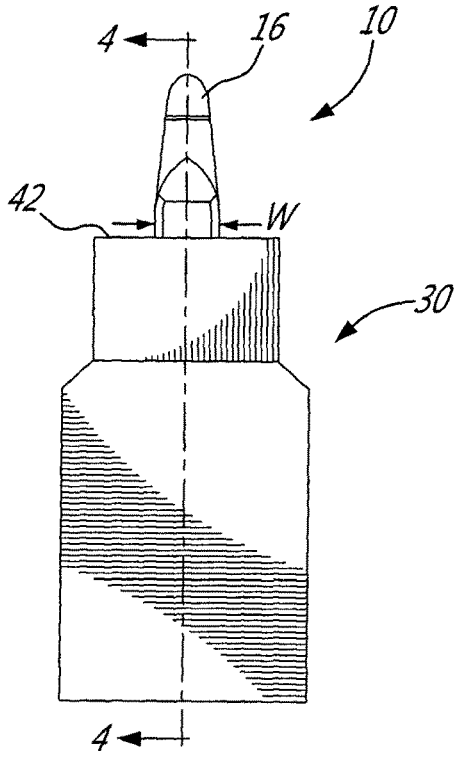
FIG. 3 is a front elevation view of the bit of FIG. 1 releasably retained in the mount of FIG. 2.

FIG. 3 shows front view of mineral bit 10 releasably retained in mount 30.

Figure 4:
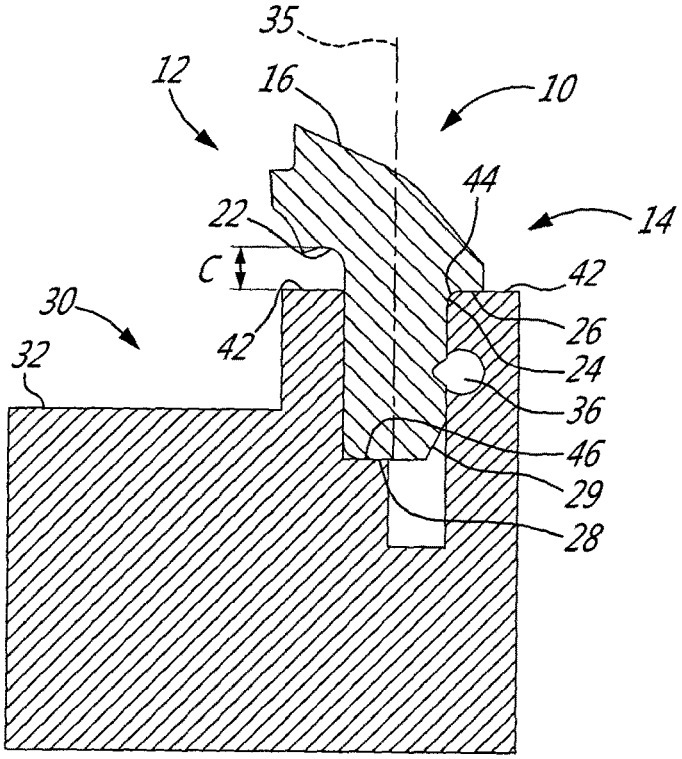
FIG. 4 is a cross-sectional view of the bit and mount of FIG. 3 along line 4-4 of FIG. 3.

FIG. 4 is a cross-sectional view of mineral bit 10 releasably retained in mount 30 taken along line 4-4 in FIG. 3. As explained above, mounting portion 18 of mineral bit 10 may be inserted (e.g., slid) into receptacle 34 by substantially linear movement of mineral bit 10 along receptacle axis 35. Once fully inserted, rear shoulder surface 26 of mineral bit 10 may interface with top surface 42 of mount 30. Such interfacing of surfaces between mineral bit 10 and mount 30 may provide support for mineral bit 10 during use. For example, at least a portion of rear shoulder surface 26 may be oriented generally transversely (e.g., perpendicular) to receptacle axis 35 and a corresponding portion of top surface 42 may be similarly oriented (e.g., extend laterally relative to receptacle axis 35). Rounded transition 44 provided on mount body 32 may also interface with rear rounded transition 24 and may have a cooperating geometry thereto.

While rear shoulder surface 26 may provide an interface between a rear region of head portion 16 and mount body 32, the exemplary mineral bit 10 shows that no corresponding shoulder surface may be provided between a front region of head portion 16 and mount 30. Instead, front rounded transition 22 may be disposed at a higher elevation than rear rounded transition 24 (and also than top surface 42) so that a clearance C may be provided between a front region of head portion 16 and top surface 42 of mount 30. Clearance C may be configured and dimensioned to allow insertion of a conventional or other suitable bit-removal tool (not shown) between mount 30 and head portion 16. Such bit-removal may be a suitable prying tool and/or may be configured to facilitate the application of a force along axis 35 to pull mineral bit 10 away from mount 30.

As shown in FIGS. 1 and 4, front rounded transition 22 may have a generally circular profile with a sweep angle that is greater than 90 degrees. Accordingly, front rounded transition 22 may provide a recessed portion into which the bit-removal (e.g., prying) tool may be inserted and seated. The recessed portion of front rounded transition 22 may facilitate the application of a pulling force and also reduce the likelihood such bit-removal tool becoming disengaged (e.g., slipping) from mineral bit 10. Alternatively, in some embodiments, a front shoulder surface (not shown) could be provided on a front region of head portion 16 to interface with top surface 42 of mount 30. In such embodiments, front rounded transition 22 could also interface with top surface 42 so that an interface between a front region of head portion 16 and mount 30, analogous to the interface between the rear region of head portion 16 and mount 30, would be provided.

Side walls of mounting portion 18 may interface with corresponding side walls of receptacle 34 when mounting portion 18 is releasably retained in receptacle 34. In addition, lower shoulder surface 28 of mounting portion 18 may also interface with corresponding ledge 46 provided inside receptacle 34. The interface between lower shoulder surface 28 and ledge 46 may provide additional support of mineral bit 10 and may be used in addition to or instead of an interface between a front region of head portion 16 and mount 30.

Figure 5:
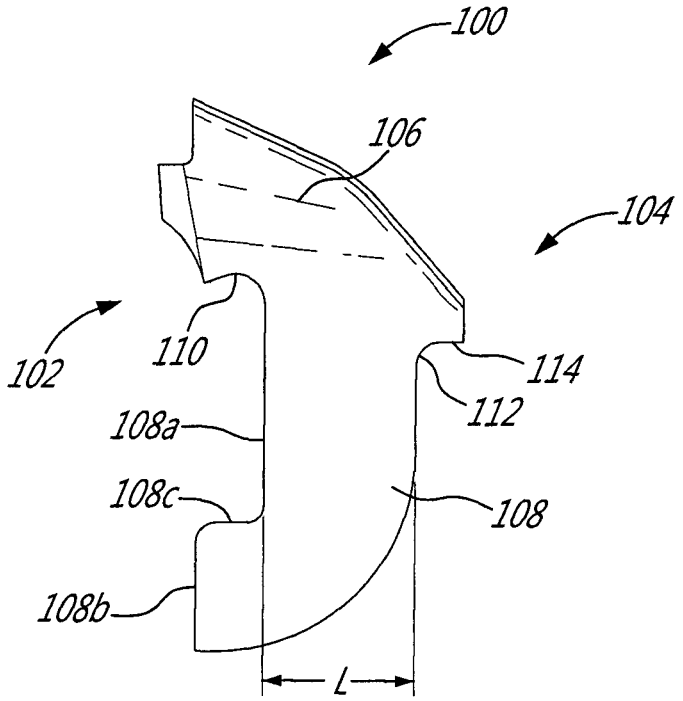
FIG. 5 is a side elevation view of a mineral bit in accordance with another exemplary embodiment.

FIG. 5 shows is a side elevation view of another mineral bit 100 in accordance with another exemplary embodiment of the present disclosure. Mineral bit 100 may be used in applications similar to those for which mineral bit 10 can be used. It will be apparent from the following description that aspects of mineral bit 10 and mount 30 already described above are also applicable to mineral bit 100 and its associated mount. Accordingly, such detailed description of those aspects will not be repeated.

One distinction between mineral bit 10 and mineral bit 100 is that mineral bit 100 may be inserted and/or withdrawn from its associated mount by rotation of mineral bit 100 relative to its mount. Mineral bit 100 may comprise one or more front regions 102, which may face mineral (e.g., rock/dirt) during use and one or more rear regions 104, which may be disposed opposite front region(s) 102. Mineral bit 100 may comprise one or more head portions 106 and one or more mounting portions 108 (e.g., shanks). Head portion 106 may be configured to contact, cut and/or otherwise process rock/dirt or other type of mineral. Head portion 106 may, for example, be configured to have an integrally formed cutter/processing region and/or may be configured to receive and hold a replaceable cutter/processing insert, which may be made of a material having a relatively high wear resistance (e.g., carbide and/or hardened steel).

Mounting portion 108 may be secured to head portion 106 and be used for releasably coupling mineral bit 100 to a drilling machine or other suitable piece of equipment. Mineral bit 100 may, in some embodiments, comprise one or more front rounded transitions 110 disposed in front region 102 of mineral bit 100 between head portion 106 and mounting portion 108. Mineral bit 100 may also comprise, in some embodiments, one or more rear rounded transitions 112 disposed in rear region 104 of mineral bit 100 between head portion 106 and mounting portion 108. One or both of front rounded portion(s) 110 and rear rounded portion(s) 112 may provide improved resistance to fatigue crack initiation and eventual fatigue failure in comparison with other known bits having sharp transitions by reducing the magnitude of stress concentrations that can be associated with sharp transitions.

For example, front rounded portion 110 may have a radius of curvature that is at least 20% of a front-to-rear length L of mounting portion 108. In some embodiments, front rounded portion 110 may, for example, have a radius of curvature between 23% and 30% of the front-to-rear length L of mounting portion 108. Front rounded portion 110 may extend across at least a portion of a width W (shown in FIG. 7) or substantially entirely across width W.

For example, rear rounded portion 112 may have a radius of curvature that is at least 12.5% of front-to-rear length L of mounting portion 108. In some embodiments, front rounded portion 110 may, for example, have a radius of curvature between 15% and 20% of the front-to-rear length L of mounting portion 108. Rear rounded portion 112 may extend across at least a portion of a width W (shown in FIG. 7) or substantially entirely across width W.

Mounting portion 108 may comprise a generally elongated upright portion 108*a* configured to be inserted in a suitable mount. In some embodiments, mounting portion 108 may have a generally rectangular transverse cross-section. For example, mounting portion 108 may have a front-to-rear length L and a width W. For example, length L may be greater than width W and in some embodiments, length L may be two or more times the width W. The transverse cross-section may not necessarily be perfectly rectangular and also the transverse cross-section may not necessarily be constant across the entirety of mounting portion 108. For example, the transverse cross-section may comprise rounded corners and/or other discontinuities. Mounting portion 108 may comprise one of more first protrusions 108*b* extending laterally from upright portion 108*a*. First protrusion 108*b* may serve as an interlocking feature for releasably retaining mineral bit 100. For example, first protrusion may comprise first interlocking surface 108*c*. One or more rounded transitions may be provided between upright portion 108*a* and first protrusion 108*b*. In some embodiments, mounting portion 108 may be generally J-shaped as illustrated in FIG. 5.

Mineral bit 100 may also comprise, in some embodiments, one or more shoulder surfaces for interfacing with an associated mount (see FIG. 6) and providing support for mineral bit 100. For example, mineral bit 100 may comprise one or more rear shoulder surfaces 114. Rear shoulder surface 114 may be disposed in rear region 104 of mineral bit 100. For example, rear shoulder surface 114 may be disposed in a lower part of head portion 106.

Figure 6:
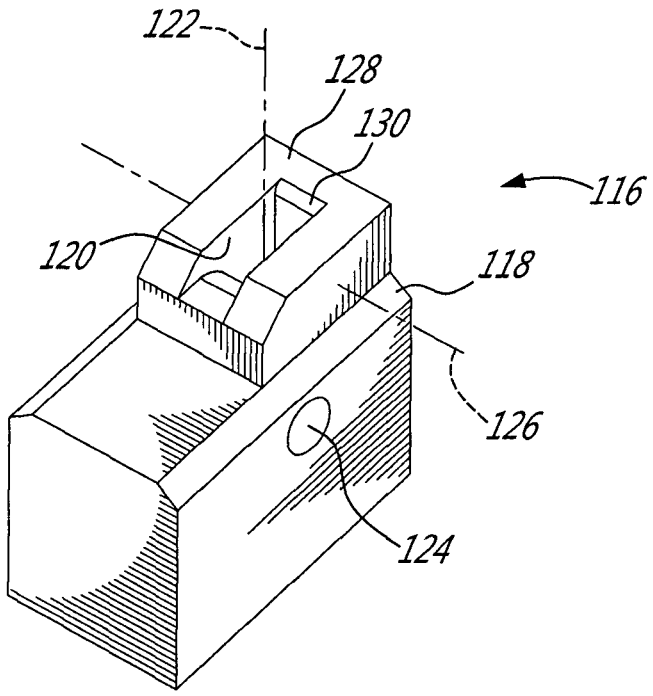
FIG. 6 is an axonometric view of a mount for releasably retaining the mineral bit of FIG. 5.

FIG. 6 illustrates mount 116 for releasably retaining mineral bit 100. Mount 116 may serve to releasably couple mineral bit 100 to a drum of a drilling machine or other suitable piece of equipment. Mount 116 may comprise mount body 118 through which one or more receptacles 120 may be formed. Receptacle 120 may be shaped and dimensioned to receive at least part of mounting portion 108 of mineral bit 100. Accordingly, receptacle 108 may also have a corresponding generally rectangular transverse cross-section. Receptacle 120 may have a receptacle axis 122. Receptacle axis 122 may extend generally along a longitudinal direction of receptacle 122. For example, receptacle axis 122 may represent a line (e.g., direction) along which linear movement mounting portion 18 of mineral bit 10 may be prevented by interlocking features described further below.

Mount 116 may also comprise one or more access holes 124. Access hole 124 may be configured to permit insertion of a suitable bit-removal tool to facilitate withdrawal of mineral bit 100 from mount 116. Access hole 124 may extend into receptacle 120 generally transversely (e.g., perpendicular) to receptacle axis 122 and provide access to mounting portion 108 from outside of mount body 118. For example, such bit-removal tool may include a suitable tapered (e.g., conical) tool that may be used to apply a force to initiate rotation of mounting portion 108 and thereby initiate withdrawal (e.g., rotation) of mounting portion 108 from receptacle 120. For example, such bit-removal tool may be inserted in access hole 124 and engaged to first protrusion 108*b* of mounting portion 108 in order to initiate rotation of mineral bit 10 in a direction opposite from which was used for insertion of mounting portion 108 into receptacle 120. The rotation of mounting portion 108 required for insertion and/or removal may be about a rotation axis other than receptacle axis 122 along which linear movement of mineral bit 10 may be restricted or prevented. For example, rotation axis 126 may be non-parallel to receptacle axis 122. In some embodiments, rotation axis 126 may be transverse (e.g., substantially perpendicular) to receptacle axis 122. The use of such tapered bit-removal tool may facilitate the removal of mounting portion 108 from receptacle 120 if, for example, head portion 106 has broken off from mounting portion 108 and hence cannot be used for applying a suitable force to withdraw mounting portion 108 from receptacle 120

The use of such bit-removal tool may also facilitate the breaking of any hold provided by fine dust that may have crept between mounting portion 18 and receptacle 34 during use. In some embodiments, the hold provided by such fine dust may be easier to break using initial rotational movement of mineral bit 100 as opposed to linear movement. In some embodiments, the initiation of a rotational movement of mounting portion 108 may require less effort than the initiation of a linear movement. If a region between mount 116 and mineral bit 100 has been packed with fines creating a significant hold on mineral bit 100, the use of rotational movement may make the task of removing mounting portion 108 from receptacle 120 easier in comparison with the linear withdrawal of other conventional bits.

Mount 116 may also include one or more top surfaces 128, which may be disposed adjacent an opening of receptacle 120. For example, top surface 128 may at least partially surround the opening of receptacle 120. Top surface 128 may provide a corresponding surface for interfacing with one or more shoulder surfaces such as shoulder surface 114 of mineral bit 100. Mount 116 may also comprise one or more rounded transitions 130 disposed between top surface 128 and receptacle 120.

Figure 7:
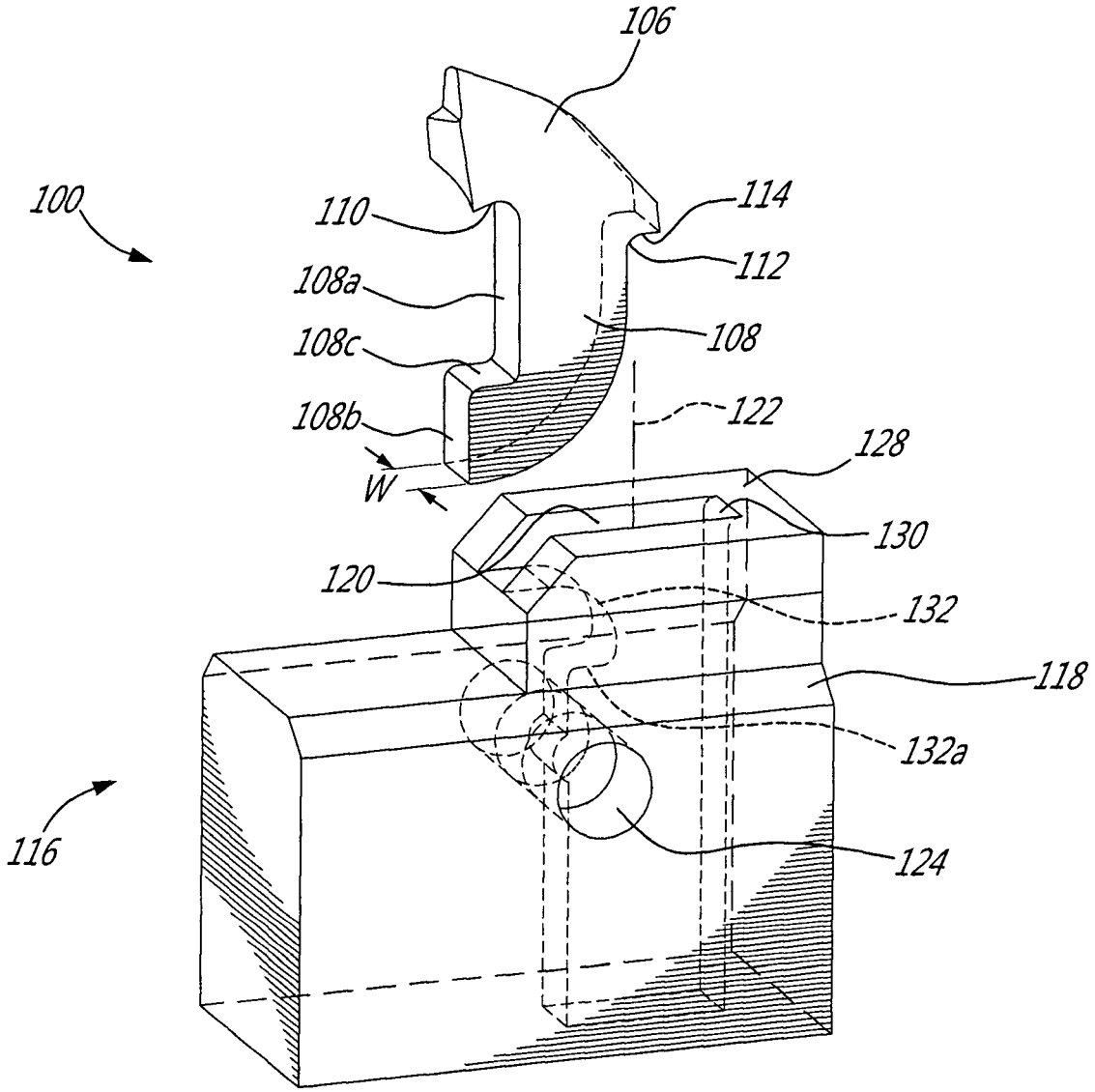
FIG. 7 is an axonometric view showing the bit of FIG. 5 and the mount of FIG. 6 prior to insertion of the bit into the mount.

FIG. 7 shows an axonometric view showing mineral bit 100 and mount 116 prior to insertion (i.e., exploded view) of mineral bit 100 into mount 116. FIG. 7 also shows internal details of receptacle 120. For example, mount 116 may comprise second protrusion 132 including second interlocking surface 132*a*. Second protrusion 132 may extend laterally into receptacle 120. One or more rounded transitions may be provided between second protrusion 132 and one or more other parts of mount 116. Such rounded transitions may interface with mounting portion 108 when mineral bit 100 is releasably retained by mount 116. For example, second protrusion 132 may extend substantially transverse to receptacle axis 122 and thereby form a passage of reduced size (i.e., a narrowed passage) within receptacle 120. Second interlocking surface 132*a* may cooperate with first interlocking surface 108*c* of mounting portion 108 of mineral bit 100 to thereby prevent withdrawal of mineral bit 100 linearly along receptacle axis 122 when mounting portion 108 of mineral bit 100 is releasably retained in receptacle 120. In some embodiments, at least part of first interlocking surface 108*c* and at least part of second interlocking surface 132*a* may be generally transverse to receptacle axis 122.

Figure 8:
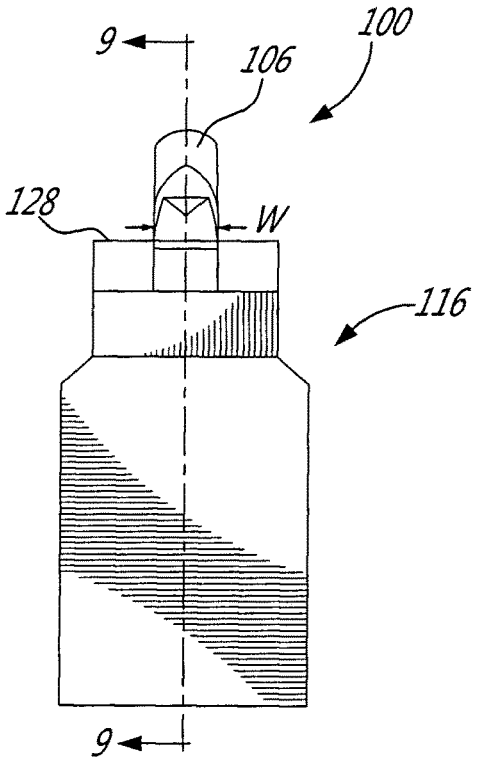
FIG. 8 is a front elevation view of the bit of FIG. 5 in the process of being inserted into or removed from the mount of FIG. 6.

FIG. 8 is a front elevation view of mineral bit 100 in the process of being inserted into or removed from mount 116.

Figure 9:
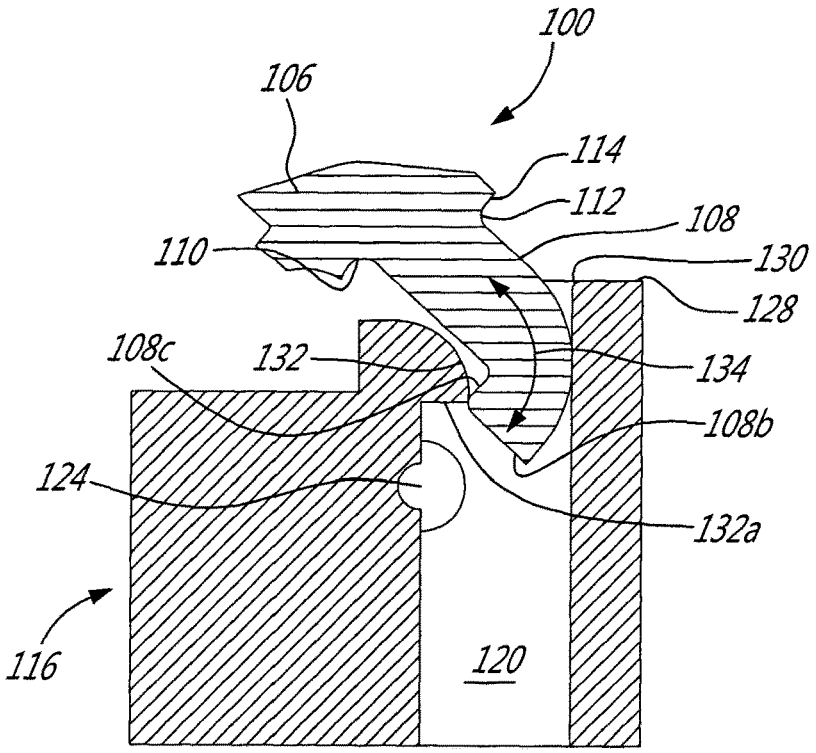
FIG. 9 is a cross-sectional view of the bit and mount of FIG. 8 along line 9-9 of FIG. 8.

FIG. 9 is a cross-sectional view of mineral bit 100 taken along line 9-9 in FIG. 8. During insertion into and/or removal from receptacle 120, it may be necessary to rotate mineral bit 100 relative to mount 116 so that first protrusion 108*b* of mounting portion 108 and second protrusion 132 of mount 116 may either engage or disengage each other. Rotation of mineral bit may be done about rotation axis 126 and may result in movement of mineral bit 100 along arrow 134. In some embodiments the relative movement required between mineral bit 100 and mount 116 may include rotation and translation. Accordingly, rotation axis 126 may not be fixed relative to receptacle axis 122 or mount 116. In any case, mineral bit 100 may be oriented so that at least part (e.g., a lower part comprising first protrusion) of mounting portion 108 may pass through the narrowed passage formed in receptacle 120 by second protrusion 132. Accordingly, such orientation of mineral bit 100 relative to mount 116 may be referred to as a release orientation permitting passing of first protrusion 108*b* of mounting portion 108 through the narrowed passage formed by second protrusion 132.

Figure 10:
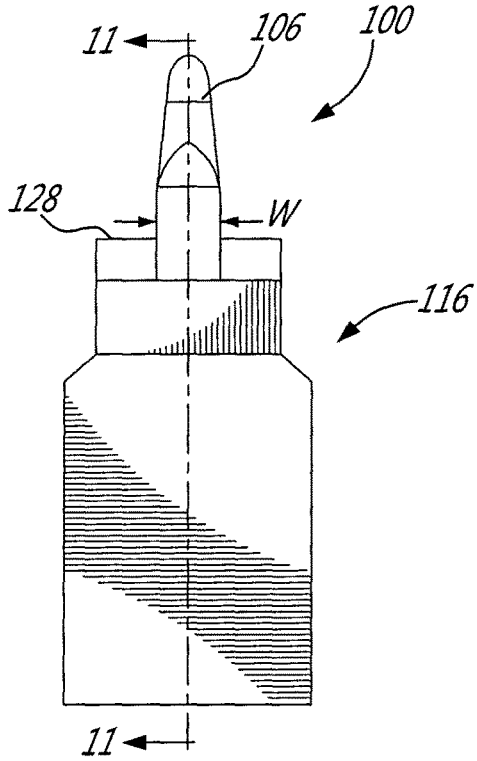
FIG. 10 is a front elevation view of the bit of FIG. 5 being releasably retained by the mount of FIG. 6.
Figure 11:
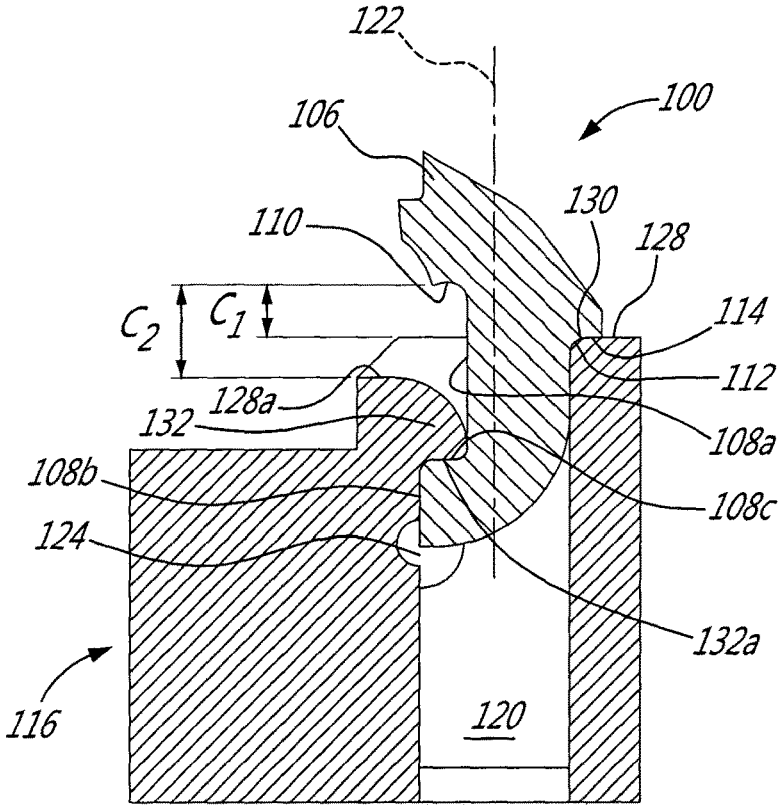
FIG. 11 is a cross-sectional view of the bit and mount of FIG. 10 along line 11-11 of FIG. 10.

FIG. 10 is a front elevation view of mineral bit 100 being releasably retained by mount 116;

FIG. 11 is a cross-sectional view of mineral bit 100 and mount 116 along line 11-11 of FIG. 10 while mineral bit 100 is releasably retained by mount 116. As mentioned above, at least part of mounting portion 108 of mineral bit 10 may be inserted into receptacle 120 by relative movement of mineral bit which may include a rotational component. Once fully inserted, rear shoulder surface 114 of mineral bit 100 may interface with top surface 128 of mount 116. Rear rounded transition 112 may be disposed adjacent rear shoulder surface 114 and may also serve as a shoulder surface for interfacing with mount 116. Such interfacing of surfaces between mineral bit 100 and mount 116 may provide support for mineral bit 100 during use. For example, at least a portion of rear shoulder surface 128 may be oriented generally transversely (e.g., perpendicular) to receptacle axis 122 and a corresponding portion of top surface 128 may be similarly oriented. Rounded transition 130 provided on mount body 116 may also interface with rear rounded transition 112 and may have a cooperating geometry thereto.

While rear shoulder surface 114 may provide an interface between a rear region of head portion 106 and mount body 116, the exemplary mineral bit 100 shows that no corresponding interface may be provided between a front region of head portion 106 and mount 116. Instead, front rounded transition 110 may be disposed at a higher elevation than rear rounded transition 114 so that a clearance C1 may be provided between a front region of head portion 106 and top surface 128 of mount 116. Mount 116 may also comprise lowered top surface 128*a*, which may be at a different elevation than top surface 128. Lowered top surface 128*a* may be provided adjacent to a front region of head portion 106 and may facilitate rotation of mineral bit 100 relative to mount 116. Accordingly, front rounded transition 110 may also provide a clearance C2 between a front region of head portion 106 and lowered top surface 128*a* of mount 116. Clearance C1 and/or C2 may be configured and dimensioned to allow insertion of a suitable bit-removal tool between mount 116 and head portion 106. As shown in FIGS. 5 and 11, front rounded transition 110 may have a generally circular profile with a sweep angle that is greater than 90 degrees. Accordingly, front rounded transition 110 may provide a recessed portion into which the bit-removal tool may be inserted and seated. Alternatively, in some embodiments, it may be appropriate to have a front shoulder surface (not shown) be provided on a front region of head portion 16 to interface with top surface 128 of mount 116 during use.

Side walls of mounting portion 108 may interface with corresponding side walls of receptacle 120 when mounting portion 108 is releasably retained in receptacle 120. Also, while mineral bit 100 may be releasably retained by mount 116, first interlocking surface 108*c* of mounting portion 108 may cooperate with second interlocking surface 132*a* of mount 116 to prevent withdrawal of mineral bit 100 linearly along receptacle axis 122. This may be referred to as the in-use orientation of mineral bit 100. As explained above in relation to FIG. 9, rotation of mineral bit 100 relative to mount 116 may be required to cause disengagement of first interlocking surface 108*c* and second interlocking surface 132*a* and such rotation may be about rotation axis 126, which may be different from (e.g., non-parallel to, transverse to) receptacle axis 122.

A method for withdrawing mineral bit 100 from mount 116 may comprise: accessing receptacle 120 of mount 116 with a suitable bit-removal tool; using the bit-removal tool to initiate movement (e.g., rotation) of mineral bit 100 relative to mount 116; further rotating mineral bit 100 relative to mount 116 to disengage first interlocking surface 108*c* and second interlocking surface 132*a*; and withdrawing mineral bit 100 from mount 116. The rotation of mineral bit 100 may be about rotation axis 126, which may be transverse (e.g., perpendicular) to receptacle axis 122. Accessing of receptacle 120 with the bit-removal tool may be done substantially transversely to receptacle axis 122 via access hole 124.

Figure 12:
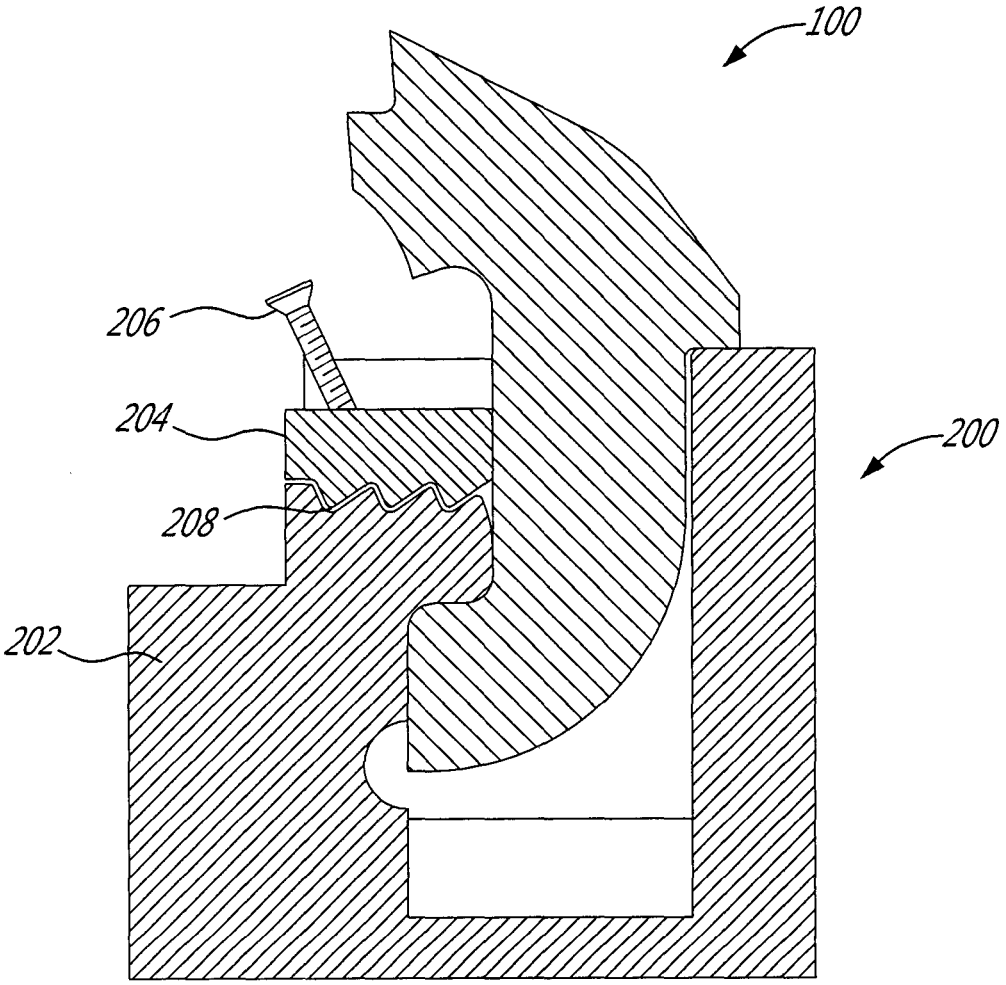
FIG. 12 is another cross-sectional view of the bit taken along line 11-11 of FIG. 10 being releasably retained in another exemplary mount having a locking mechanism.

FIG. 12 is another cross-sectional view of mineral bit 100 taken along line 11-11 being releasably retained in another exemplary mount 200. Mount 200 may comprise mount body 202 and may be configured similarly to mount 116 to permit engagement and disengagement of mineral bit 100 by rotational movement. After insertion, mineral bit 100 may be releasably retained by mount 200 via any suitable conventional or other retaining means. In some embodiments, retaining block 204 may, for example, be used to releasably retain mineral bit 100 in mount 200 by preventing rotation of mineral bit 100 relative to mount 200. For example, retaining block 204 may be removably secured to mount body 202 via one or more fasteners 206 (shown partially removed in FIG. 12). Retaining block 204 may engage mount body 202 via interface 208. Interface 208 may be configured to cause biasing of retaining block 204 against a portion of mineral bit 100. For example, retaining block 204 may be in contact with upright portion 108*a* of mineral bit 100 to prevent rotation of mineral bit 100 about rotation axis 126 and thereby also prevent withdrawal of mineral bit 100 from mount 200. Accordingly, removal of retaining block 204 may be required in order to initiate rotation of mineral bit 100 relative to mount 200 and withdraw the mineral bit 100 from mount 200.

The above description is meant to be exemplary only, and one skilled in the relevant arts will recognize that changes may be made to the embodiments described without departing from the scope of the invention disclosed. Also, one skilled in the relevant arts will appreciate that while the mineral bits and mounts disclosed and shown herein may comprise a specific number of elements/components, the mineral bits and mounts could be modified to include additional or fewer of such elements/components. For example, while any of the elements/components disclosed may be referenced as being singular, it is understood that the embodiments disclosed herein could be modified to include a plurality of such elements/components. The present disclosure is also intended to cover and embrace all suitable changes in technology. Modifications which fall within the scope of the present invention will be apparent to those skilled in the art, in light of a review of this disclosure, and such modifications are intended to fall within the appended claims.

What is claimed is:

1. A bit for use during excavation and mining operations, the bit having a front region and an opposite rear region, the bit comprising:

a head portion;

a mounting portion secured to the head portion and configured to be inserted into a mount by relative rotational movement between the bit and the mount and to be releasably retained by the mount;

a rear shoulder surface disposed on the head portion in the rear region of the bit and configured to interface with the mount when the mounting portion is releasably retained by the mount;

the mounting portion comprising one or more protrusions serving as an interlocking feature, the one or more protrusions extending laterally from the front region and having a first interlocking surface facing substantially in opposite direction to the rear shoulder surface and configured to interface with the mount; and a rear rounded transition disposed in the rear region of the bit between the head portion and the mounting portion, wherein the rear shoulder surface comprises at least a portion of the rear rounded transition.

2. The bit as defined in claim 1, further comprising a rounded transition disposed in the front region of the bit between the head portion and the mounting portion and configured to provide a clearance between the head portion and the mount when the mounting portion is releasably retained by the mount, wherein the clearance provided by the front rounded transition is configured to permit insertion of a bit-removal tool between the head portion of the bit and the mount.

3. The bit as defined in claim 1, wherein the rear rounded transition is configured to interface with the mount.

4. An apparatus for use during excavation and mining operations, the apparatus comprising:

a mount having a receptacle; and a bit having a front region and an opposite rear region, the bit comprising:

a head portion;

a mounting portion secured to the head portion, at least part of the mounting portion being configured to be inserted into the mount by relative rotational movement between the bit and the mount and to be releasably retained in the receptacle of the mount;

a rear shoulder surface disposed on the head portion in the rear region of the bit and configured to interface with the mount when the mounting portion is releasably retained by the mount;

the mounting portion comprising one or more protrusions serving as an interlocking feature, the one or more protrusions extending laterally from the front region and having a first interlocking surface facing substantially in opposite direction to the rear shoulder surface and configured to interface with the mount; and a rear rounded transition disposed in the rear region of the bit between the head portion and the mounting portion of the bit, wherein the rear shoulder surface comprises at least a portion of the rear rounded transition.

5. The apparatus as defined in claim 4, wherein the mount comprises a top surface adjacent the receptacle for interfacing with the rear shoulder surface.

6. The apparatus as defined in claim 5, further comprising a front rounded transition disposed in the front region of the bit between the head portion and the mounting portion and configured to provide a clearance between the head portion of the bit and the mount when the mounting portion is releasably retained by the mount, wherein the top surface of the mount extends to a front side of the receptacle and the front rounded transition of the bit provides the clearance between the head portion of the bit and the top surface of the mount.

7. The apparatus as defined in 6, wherein the clearance provided by the front rounded transition is configured to permit insertion of a bit-removal tool between the bit and the mount.

8. The apparatus as defined in claim 4, wherein the mount is configured to interface with the rear rounded transition.

9. A bit for use during excavation and mining operations, the bit having a front region and an opposite rear region, the bit comprising:

a head portion;

a mounting portion secured to the head portion and configured to be inserted into a mount by relative rotational movement between the bit and the mount and to be releasably retained by the mount;

a front rounded transition disposed in the front region of the bit between the head portion and the mounting portion and configured to provide a clearance between the head portion of the bit and the mount when the mounting portion is releasably retained by the mount, wherein the front rounded transition has a radius of curvature that is at least 20% of a front-to-rear length of the mounting portion; and a rear shoulder surface disposed on the head portion in the rear region of the bit and configured to interface with the mount when the mounting portion is releasably retained by the mount; and the mounting portion comprising one or more protrusions serving as an interlocking feature, the one or more protrusions extending laterally from the front region and having a first interlocking surface facing substantially in opposite direction to the rear shoulder surface and configured to interface with the mount.

10. The bit as defined in claim 9, wherein the clearance provided by the front rounded transition is configured to permit insertion of a bit-removal tool between the head portion of the bit and the mount.

11. The bit as defined in claim 9, further comprising a rear rounded transition disposed in the rear region of the bit between the head portion and the mounting portion, wherein the rear shoulder surface comprises at least a portion of the rear rounded transition.

12. The bit as defined in claim 11, wherein the rear rounded transition is configured to interface with the mount.

13. An apparatus for use during excavation and mining operations, the apparatus comprising:

a mount having a receptacle; and a bit having a front region and an opposite rear region, the bit comprising: a head portion;

a mounting portion secured to the head portion, at least part of the mounting portion being configured to be inserted into the mount by relative rotational movement between the bit and the mount and to be releasably retained in the receptacle of the mount;

a front rounded transition disposed in the front region of the bit between the head portion and the mounting portion, wherein the front rounded transition has a radius of curvature that is at least 20% of a front-to-rear length of the mounting portion; and a rear shoulder surface disposed on the head portion in the rear region of the bit and configured to interface with the mount when the mounting portion is releasably retained by the mount, the mounting portion comprising one or more protrusions serving as an interlocking feature, the one or more protrusions extending laterally from the front region and haying a first interlocking surface facing substantially in opposite direction from to the rear shoulder surface and configured to interface with the mount.

14. The apparatus as defined in claim 13, wherein the mount comprises a top surface adjacent the receptacle for interfacing with the rear shoulder surface.

15. The apparatus as defined in claim 14, wherein the front rounded transition is further configured to provide a clearance between the head portion of the bit and the mount when the mounting portion is releasably retained by the mount, wherein the top surface of the mount extends to a front side of the receptacle and the front rounded transition of the bit provides the clearance between the head portion of the bit and the top surface of the mount.

16. The apparatus as defined in 15, wherein the clearance provided by the front rounded transition is configured to permit insertion of a bit-removal tool between the bit and the mount.

17. The apparatus as defined in claim 13, further comprising a rear rounded transition disposed in the rear region of the bit between the head portion and the mounting portion of the bit, wherein the rear shoulder surface comprises at least a portion of the rear rounded transition.

18. The apparatus as defined in claim 17, wherein the mount is configured to interface with the rear rounded transition.

* * * * *